US006233901B1

(12) United States Patent
Kurfees

(10) Patent No.: US 6,233,901 B1
(45) Date of Patent: May 22, 2001

(54) DOOR FRAME INSTALLATION KIT

(76) Inventor: John R. Kurfees, 4409 St. Mark Rd., Virginia Beach, VA (US) 23455

( * ) Notice: Subject to any disclaimer, the term of this patent is extended or adjusted under 35 U.S.C. 154(b) by 0 days.

(21) Appl. No.: 09/435,432

(22) Filed: Nov. 8, 1999

(51) Int. Cl.[7] ..... E04D 15/00
(52) U.S. Cl. ..... 52/749.1; 52/309.4; 52/127.2
(58) Field of Search ..... 52/127.2, 146, 52/309.4, DIG. 1, 749.13, 749.1; 33/194, 568

(56) References Cited

U.S. PATENT DOCUMENTS

| | | | | |
|---|---|---|---|---|
| 2,895,229 | * | 7/1959 | Strickland | 33/194 |
| 3,710,447 | * | 1/1973 | Howlett | 33/194 |
| 4,731,279 | * | 3/1988 | Isshiki | 428/159 |
| 5,167,073 | * | 12/1992 | Stein | 33/194 |
| 5,253,839 | * | 10/1993 | McClure | 248/354.1 |
| 5,377,462 | * | 1/1995 | Beals | 52/127.2 |
| 5,704,171 | * | 1/1998 | Ruff | 52/127.2 |
| 5,893,243 | * | 4/1999 | Ortner | 52/211 |

FOREIGN PATENT DOCUMENTS

| | | | | |
|---|---|---|---|---|
| 2063095 | * | 9/1973 | (CA) | 52/127.2 |
| 219827 | * | 4/1968 | (SE) | 52/127.2 |
| 699149 | * | 11/1979 | (SU) | 52/127.2 |

* cited by examiner

*Primary Examiner*—Carl D. Friedman
*Assistant Examiner*—Bennett Porterie
(74) *Attorney, Agent, or Firm*—Richard L Huff

(57) ABSTRACT

A kit for preventing the movement of door frames during the time that brick and mortar are being erected around the frames. As one element of the kit, there is at least one block which fits between the door jambs to prevent inward or outward bowing of the jambs. The blocks contain peripheral holes which contain protective clips. The blocks may be tied in place at the desired location by passing a tie through the appropriate holes and around the doorjamb. A second element of the kit is at least one supporting brace which prevents movement of the door frame away from the vertical plane of the frame. The brace contains connecting holes at each end and, preferably, is made of telescopic tubing for ease in adjustment of length. The lower portion of the brace rotatably connects to a support. The upper end of the brace rotatably connects to a two-piece holder which removably attaches to a door jamb.

8 Claims, 8 Drawing Sheets

DOOR FRAME INSTALLATION KIT

BACKGROUND OF THE INVENTION

1. Field of the Invention

This invention is directed to a kit for bracing door frames during installation

2. Description of the Related Art

During masonry building construction, it is required to temporarily support a door frame before the adjacent walls are completed. This requires that the door frame be properly aligned to insure proper door operation. It is conventional to support the door frames with wooden braces. Metal door frames used in masonry walls contain elongate channels made from sheet metal. These channels are filled with grout or other filler during construction, and it is important that the door frames maintain their position during this process. The prior art is aware of this problem and has taken steps to correct it. U.S. Pat. No. 2,914,813 to Christian et al uses adjustable braces to maintain the door jamb upright and plumb and a horizontal strut to keep the door jamb from buckling under the force of the mortar. The mechanism of the brace is complicated while the strut offers support in only a limited area. U.S. Pat. No. 5,253,839 to McClure describes a support device having a pair of elongate support members. Each of the members is made to be positioned along, and contact a side of the door frame substantially along, the entire length of the frame. The support members are capable of being adjusted and locked in place. This device is complicated and contains a multiplicity of small pieces, which may be misplaced. U.S. Pat. No. 5,704,171 to Ruffet al disclose a support device which is a frame having outer dimensions which are the same as the inner dimensions of the door frame to be supported. This device contains a brace which pivots on the device and attaches to a support. Because of its preset size, the device of Ruff et al can be used for only a single sized door. Also, since the device attaches to the frame being supported by screws fitted into pre-drilied holes in the frame, each device is limited to support of only a single size door. This device is bulky and therefore difficult to transport. Thus, the devices of the prior art, while solving the existing problem, have not done so in the most expeditious manner, and drawbacks exist in the devices of the prior art. It is the purpose of this invention to solve the problem of stabilizing a door frame of a masonry building under construction while avoiding the drawbacks inherent in the devices of the prior art.

SUMMARY OF THE INVENTION

The present invention is drawn to a kit which is usefull in supporting door frames on masonry buildings under construction. The kit prevents bowing of a vertical door jamb and maintains the door jamb in a stable, erect position. The kit is easy to transport and is suitable for a variety of door sizes.

The kit contains a plurality of foam blocks having holes around the perimeter. Clips fit into the holes to protect the foam material, allowing the blocks to be used for a large number of times. Ties connect the blocks to the door jambs, thus preventing the door jamb from bowing while being easily mounted and dismounted. The blocks are rectangular in shape sized so that one side is equal to the distance between vertical jambs of a conventional sized door and the other side is equal to the distance between vertical jambs of a conventional door having a different size.

The kit contains a pair of braces, each being attached at one end to a holder on the door frame and to the other end to a support. Preferably the brace has a telescopic arrangement for easy adjustment.

DESCRIPTION OF THE PREFERRED EMBODIMENTS

Figure 1:
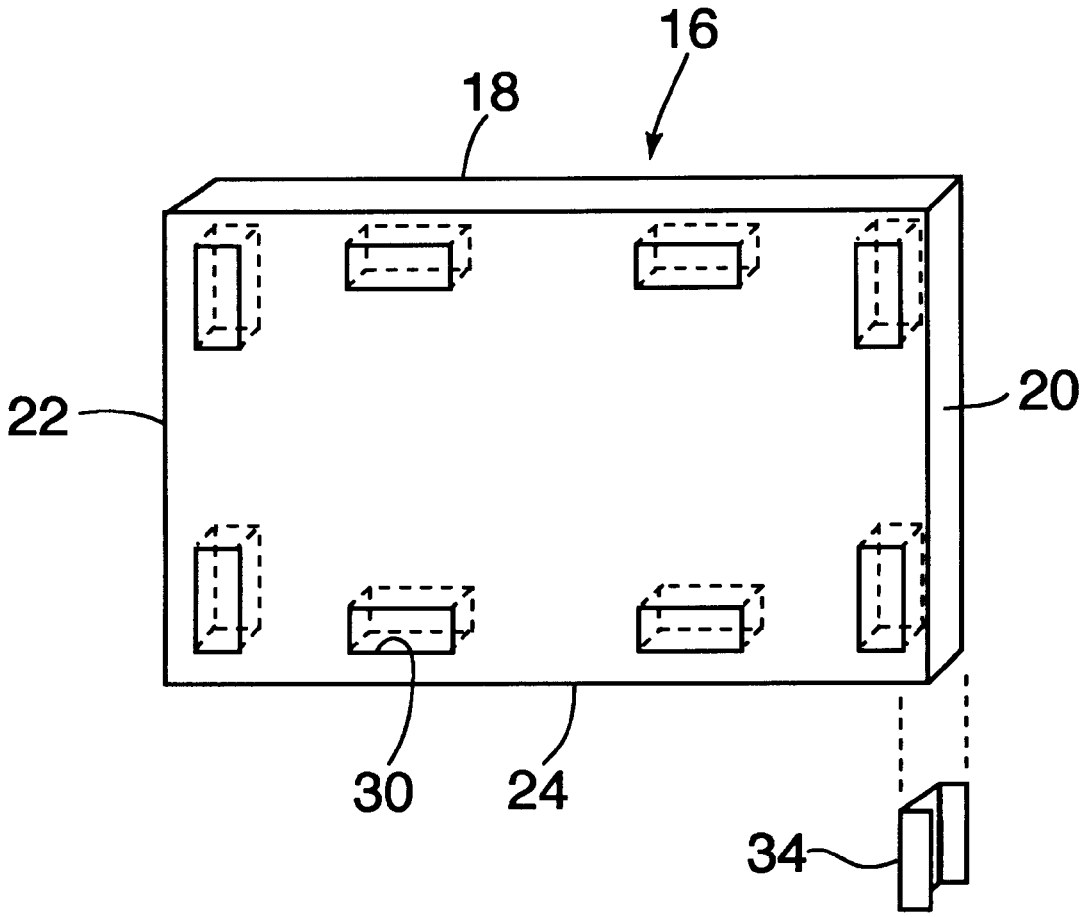
FIG. 1 is an elevational perspective view of a support block of the present invention.
Figure 2:
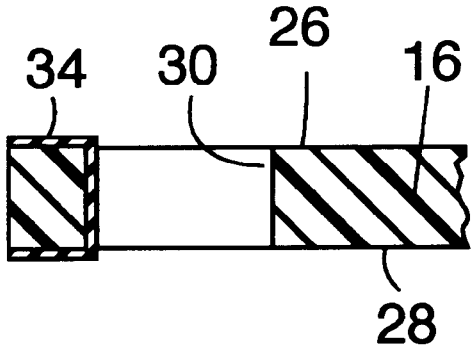
FIG. 2 is a top cross-sectional view of a portion of a support block illustrating the placement of a protective clip in a hole.
Figure 3:
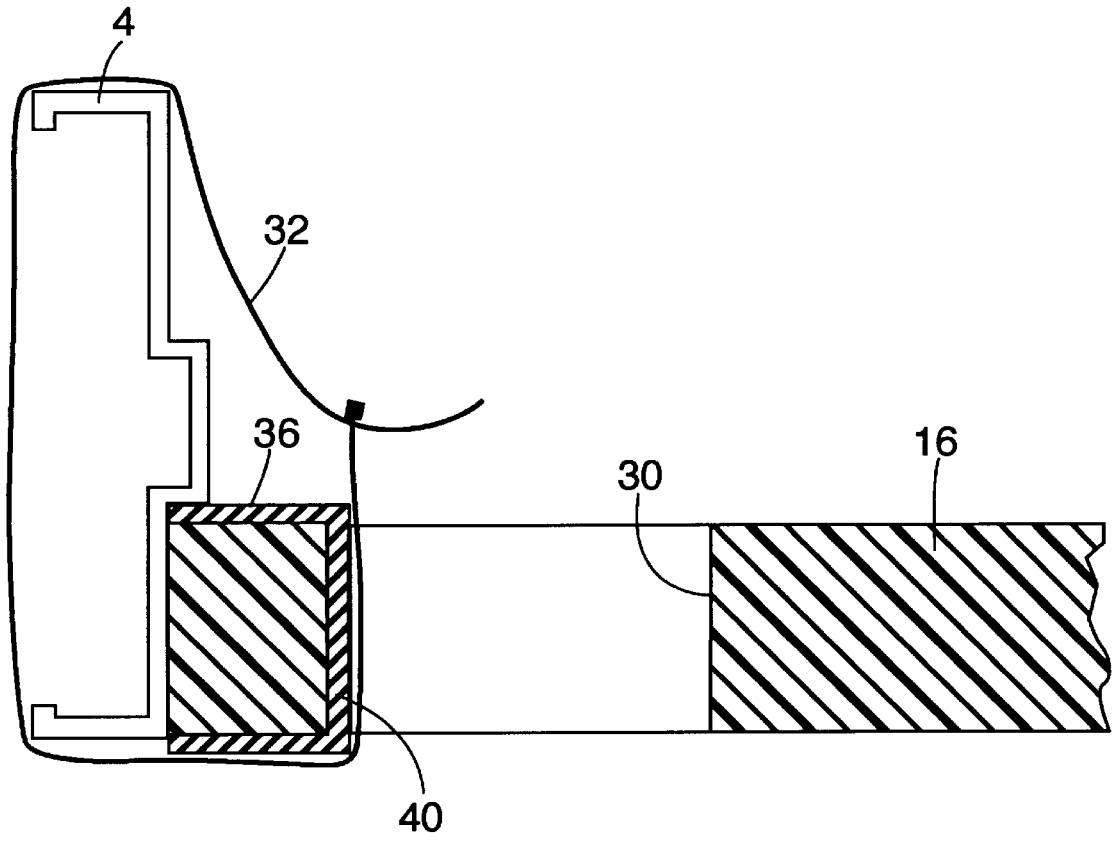
FIG. 3 is a top cross-sectional view of a portion of a support block having a protective clip held in place against a door jamb.
Figure 4:
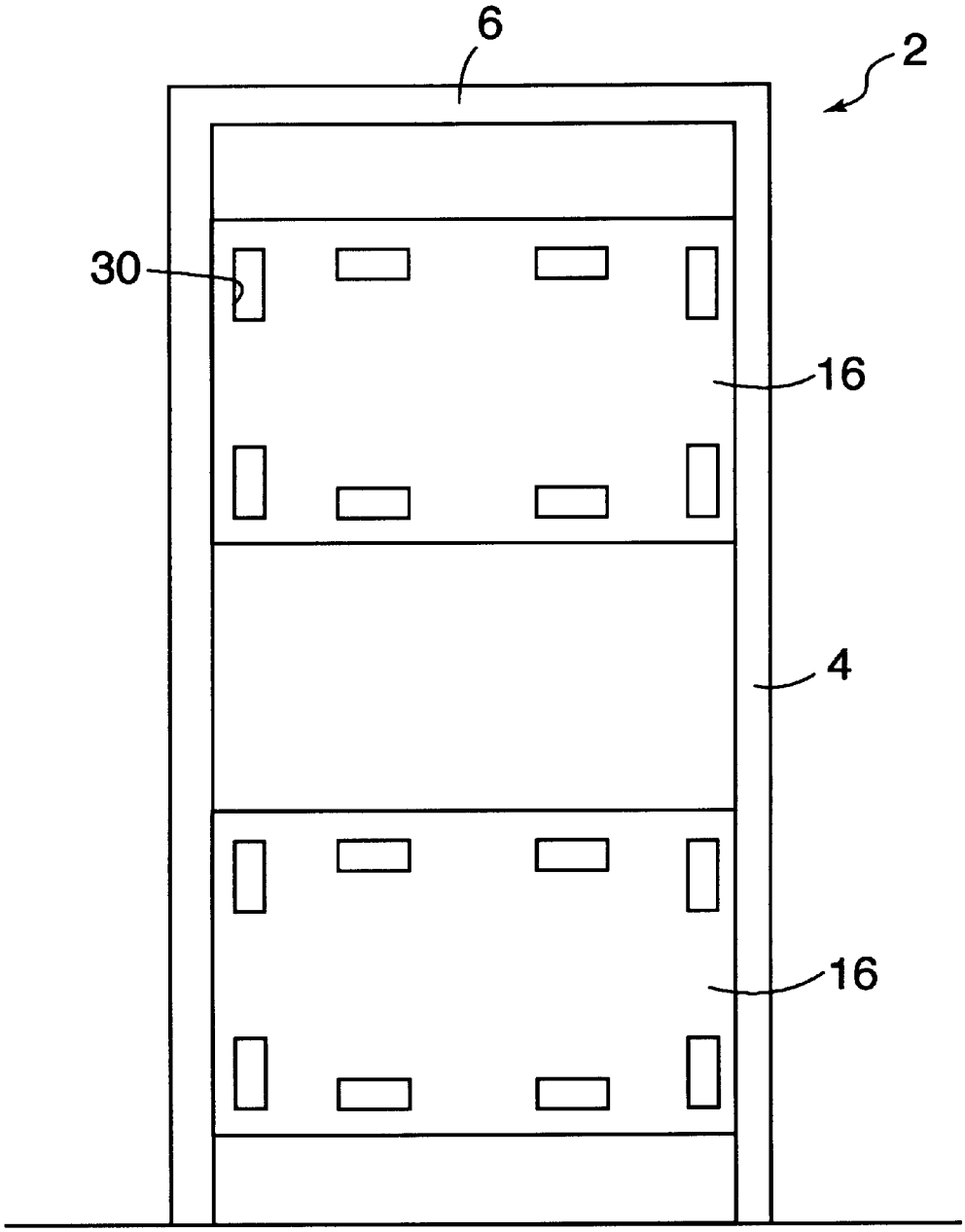
FIG. 4 is a front view of a door frame having two support blocks in place.
Figure 5:
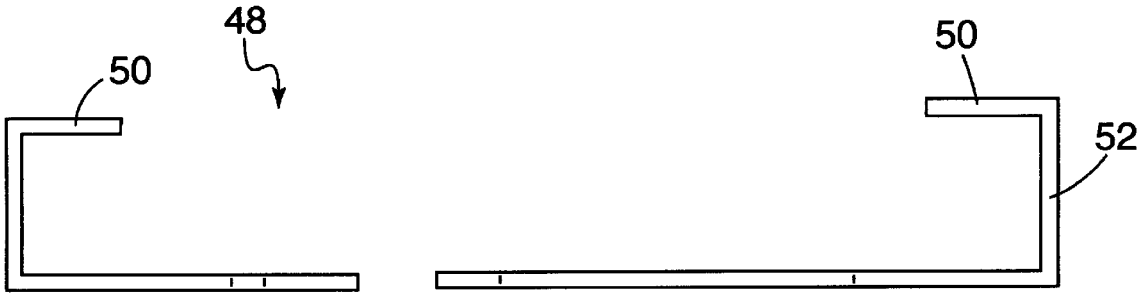
FIG. 5 is a top exploded view of the holder of this invention.
Figure 6:
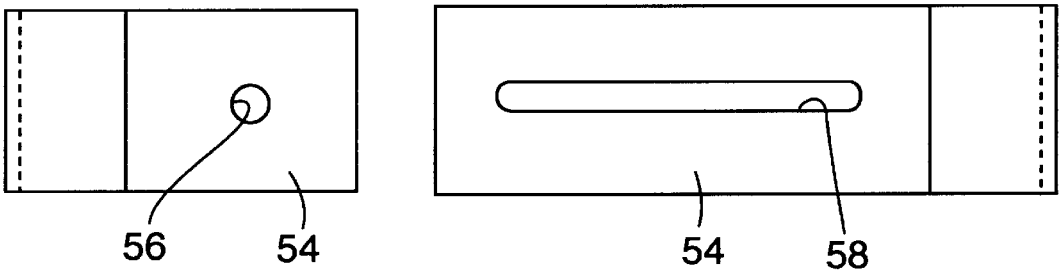
FIG. 6 is a side exploded view of the holder of this invention.
Figure 7:
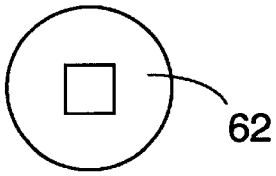
FIG. 7 is a front view of a spacer used in this invention.
Figure 8:
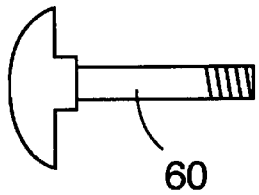
FIG. 8. is a side view of a bolt used in this invention.
Figure 9:
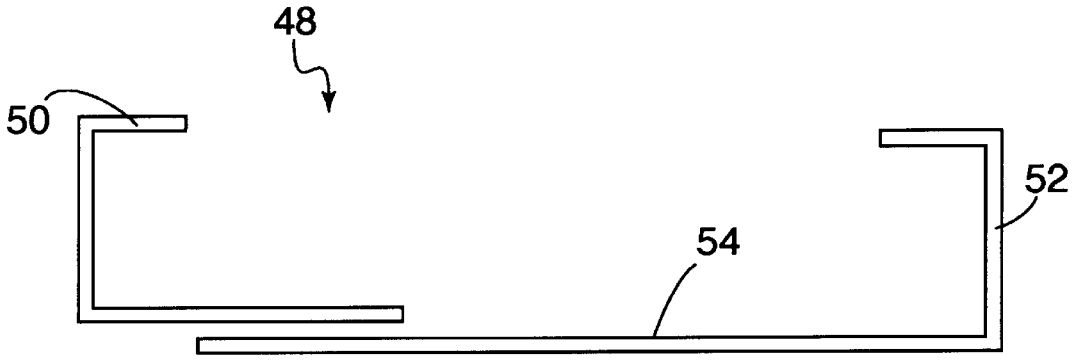
FIG. 9 is a top view of the holder of this invention.
Figure 10:
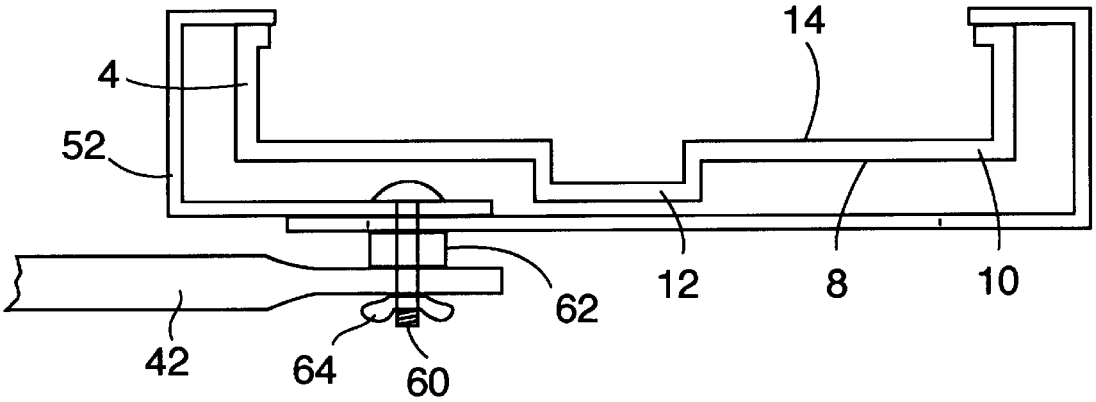
FIG. 10 is a top view partly in cross section showing a vertical door jamb having a holder in place with a brace attached.
Figure 11:
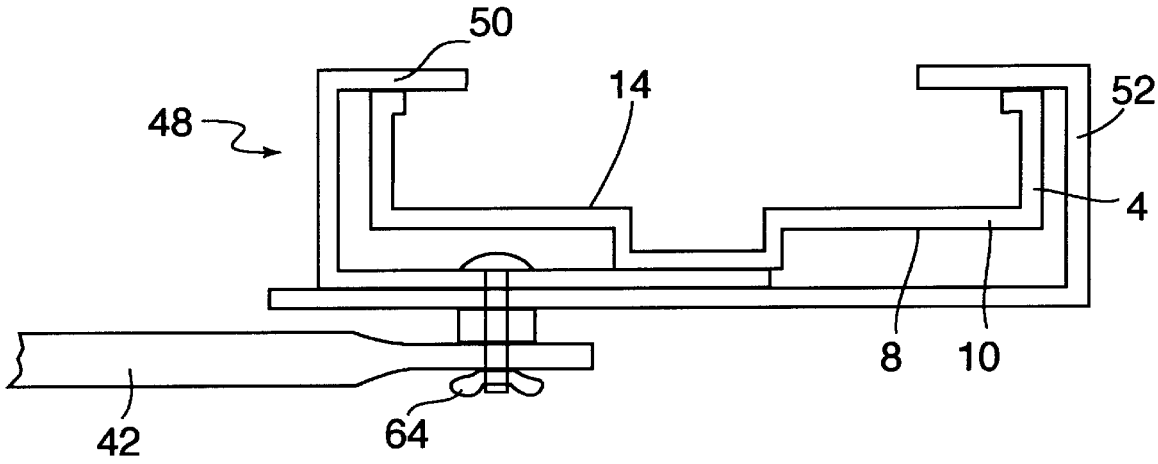
FIG. 11 is a view similar to FIG. 10 showing an alternate placement of the bolt.
Figure 12:
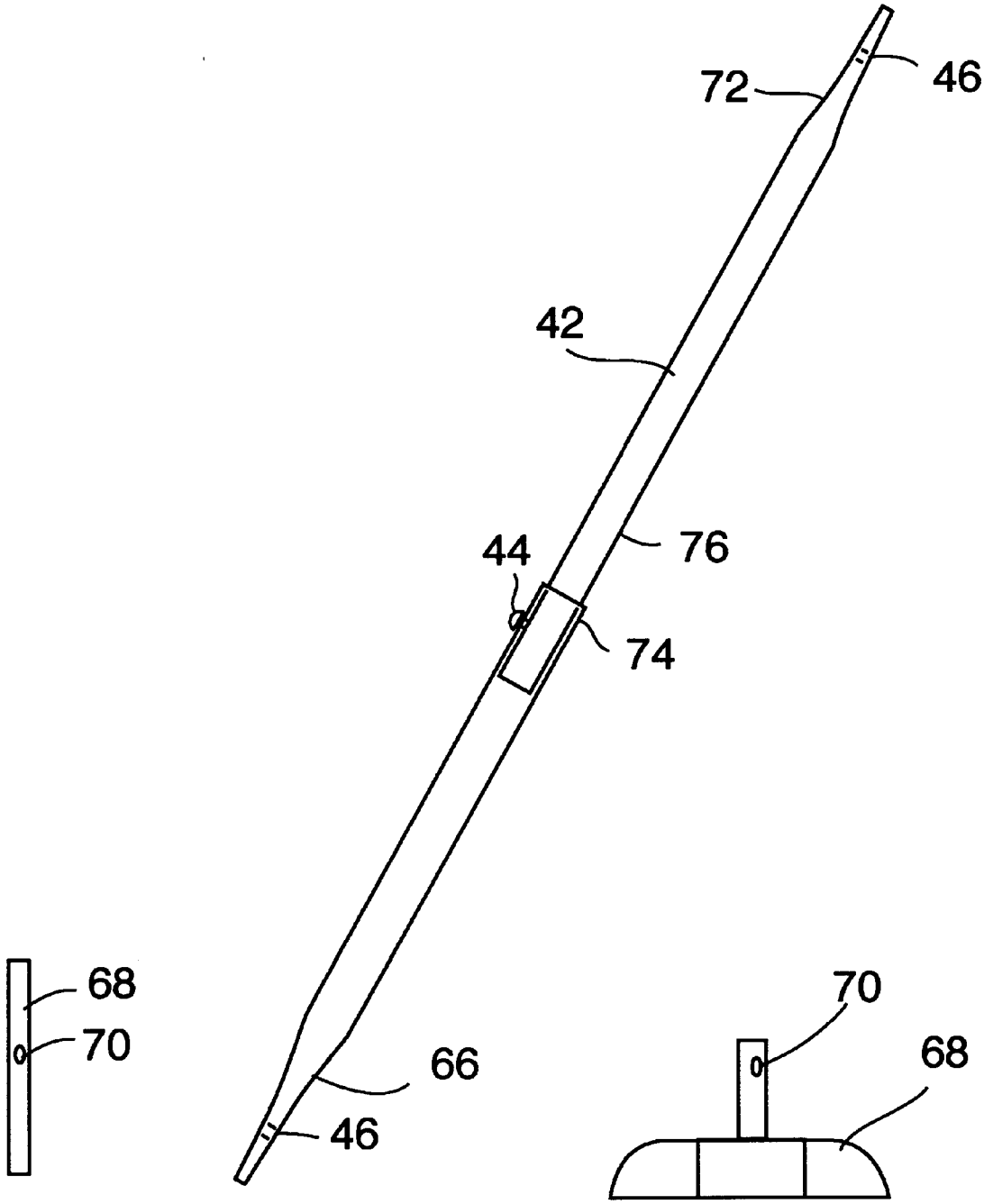
FIG. 12 is an elevational view, partially cut away, of a telescopic brace and two types of supports.
Figure 13:
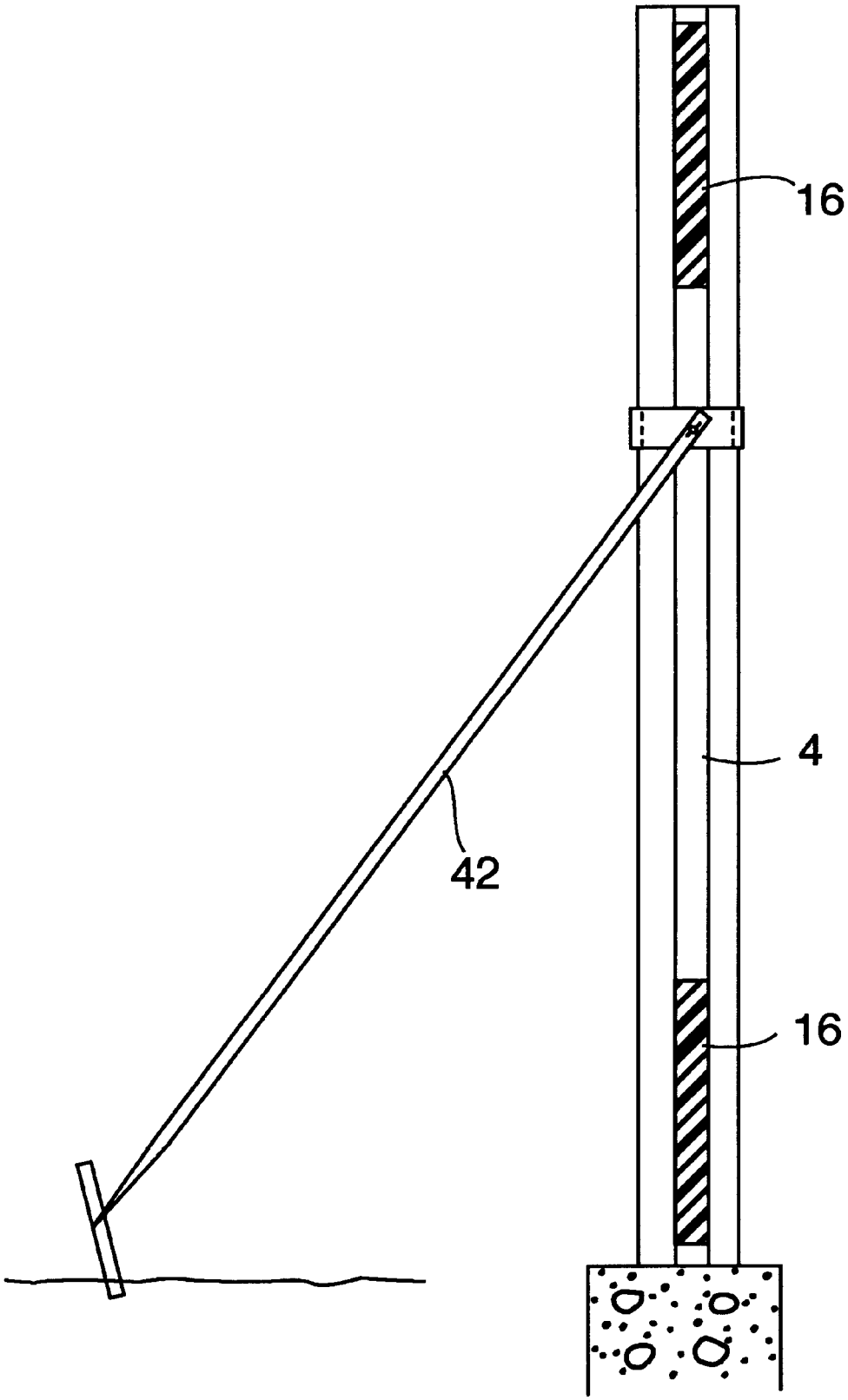
FIG. 13 is a side cross-sectional view of a door jamb having the two blocks and a brace in place.

The invention will now be described with reference to the above drawing, like numbers referring to like features throughout.

In constructing masomy buildings, door frames 2 are conventionally put into place and the walls are built to connect to the frames 2. The area of the wall between the masonry and the door frame 2 is filled with grout or other conventional filler. The door frame 2 contains two opposing vertical jambs 4 and a header 6. Each jamb 4 has an inner aspect 8 having at least one plate 10 and a doorstop 12. Each jamb 4 has one outer aspect 14 which will abut the masonry when the building is complete. Conventional door frames 2 have an inner aspect 8 height of 6'8" or 7'. Therefore, it is important to have a supporting device which is versatile and capable of use in door frames 2 of different heights. Conventional door frames 2 may vary between 2' to 4' between opposing vertical plates 10. The most common widths are 2'8" and 3'.

The block 16 of the present invention is capable of being placed within a door frame 2 while the masonry is being constructed around the frame 2 and holding the frame 2 in such a manner that it will maintain the desired position while masonry is being constructed around it.

The supporting block 16 of the present invention is made of hard, sturdy foamed plastic. The preferred plastic is Styrofoam. The block 16 is rectangular in shape. Both the height and the width have dimensions which are conventional widths of door frames 2. Thus, a block 16 which is 2'8" by 3' is preferred. A plurality of blocks 16, preferably two, is used to support a door frame 2.

Each block 16 has a top surface 18, a right side 20, a left side 22, a bottom surface 24, a distal face 26, and a proximal face 28.

Each block 16 has holes 30 around the periphery of the block 16 to allow ties 32 to pass through the block 16 and around the door frame 2 to secure the block 16 to the frame 2. While the number and location of the holes 30 is not critical, it is preferred to have a hole 30 adjacent the top surface 18 near the right side 20, a hole 30 adjacent the top surface 18 near the left side 22, a hole 30 adjacent the bottom surface 24 near the right side 20, a hole 30 adjacent the bottom surface 24 near the left side 22, a hole 30 adjacent the right side 20 near the top surface 18, a hole 30 adjacent the left side 22 near the top surface 18, a hole 30 adjacent the right side 20 near the bottom surface 24, and a hole 30 adjacent the left side 22 near the bottom surface 24. These holes 30 are preferably rectangular or square in shape, although they may be other shapes.

The kit also includes metal or plastic clips 34 which fit inside the holes 30. The clips 34 are of a "U" shape, having two sides 36 and a bottom 40. When in use, the sides 36 of the clips 34 lie between the hole 30 and a whatever surfaces 18, 20, 22, 24 of the block 16 are in contact with the door frame 2. The bottom 40 of the clip 34 fits in a hole 30 between the distal face 26 and the proximal face 28. The purpose of the clip 34 is to protect the block 16 against rubbing and cutting by the tie 32 when the block 16 is being secured in place.

The kit contains one tie 32 for each hole 30. The purpose of the tie 32 is to allow quick, easy securing and removal of the block 16 to the door frame 2. The tie 32 goes through a hole 30, around the door frame 2, and the ends are secured with a knot.

The purpose of the blocks 16 is to prevent the door frame 2 from bowing as the masonry is built around it. It is also important that the door frame 2 be kept aligned in a vertical position. This is accomplished by the use of at least one brace 42. Preferably two braces 42 are used, one for each vertical door jamb 4.

The brace 42 is a tubular rod, preferably telescopic for ease of adjustment. When telescopic, the brace 42 has a tightening mechanism 44, preferably a bolt-type or wing nut mechanism for ease and reliability of use. The brace 42 has a securing hole 46 at each end.

A holder 48 is used to pivotally secure the brace 42 to the door frame 2. The holder 48 is a two-piece device, each piece having a general "J" shape comprising a hook 50, a bottom 52, and a face 54. The hook 50 of each holder 48 fits around and secures the outer aspect 14 of the door frame 2. The face 54 of one holder 48 has a bolt hole 56. The face 54 of the other holder 48 has a bolt slot 58 to allow for attachment of the holder 48 to door frames 2 of various dimensions. The bottom 52 of the "J" is of such a length as to assure clearance between the faces 54 with any attached holding means and the door jamb 4. The brace 42 is pivotally attached to the holder 48 by means of a bolt 60, spacer 62, and nut 64.

The bottom end 66 of the brace 42 is fixed to a support 68. The support 68 may be a stake secured to the surface or a flat metal plate which will lie flat on the surface. The support 68 contains a hole 70 which will allow pivotal attachment of the brace 42.

The kit of this invention may be used to prevent unwanted movement in door frames 2 after they have been put in place and before a mortar and brick or cinder block structure has been secured to them.

In use, a door frame 2 is put into place. At least one supporting block 16 having holes 30 with protecting clips 34 in the appropriate holes 30 is inserted into the door frame 2 between two vertical jambs 4. The distal face 26 of the block 16 abuts with the doorstop 12 and the sides 20 22 of the block 16 abut with the plate 10 on the inner aspect 8 of the door jamb 4. Ties 32 are placed through the protected holes 30 and around the door frame 2 to hold the block 16 in place. The top end 72 of at least one brace 42 is removably secured to the inner aspect 8 of the door jamb 4 with a holder 48. The bottom end 66 of the brace 42 is secured to the ground or floor by a support 68. Preferably, the length of the brace 42 is adjustable. Adjustability may be obtained by preparing the brace 42 from telescopic tubes 74 76 maintained the proper setting with a tightening mechanism 44.

When the door frame 2 is securely held in place by the surrounding structure, the supporting block 16 and brace 42 are removed and may be used repeatedly.

It is apparent that obvious modifications may be made in the invention as described. It is the inventor's position that such modifications be included within the scope of the invention, which is to be limited by the scope of the appended claims.

What is claimed is:

1. A combination of a first conventional door frame and a kit for stabilizing the door frame while the door frame is being installed, wherein:

the door frame has a generally rectangular interior; two set-apart opposed jambs, each jamb having an inner aspect containing at least one plate having a height and a width and a doorstop; an outer aspect; and a connecting header, and wherein:

the kit comprises two foam blocks, each block having a front surface, a rear surface, a top surface, a bottom surface, one right side surface, and one left side surface, each block having a depth approximately equal to a the width of the door plate of the first door frame, a first dimension equal to the distance between two opposed plates of the two opposed door jambs of the first conventional door frame, and a second dimension equal to the distance between two corresponding opposed plates of door jambs of a second conventional door frame having dimensions approximating but different from the first door frame being installed, each of the blocks comprising eight holes extending from the front surface to the rear surface such that there is a hole adjacent the top surface near the right side, a hole adjacent the top surface near the left side, a hole adjacent the bottom surface near the right side, a hole adjacent the bottom surface near the left side, a hole on the right side near the top surface, a hole on the left side near the top surface, a hole on the right side near the bottom surface, and a hole on the left side near the bottom surface.

2. The combination as described in claim 1, wherein for each block there are four "U"-shaped clips, each clip having two sides and one bottom and being so sized as to fit into one of the eight holes of the block so that each of the two sides of the clip fits between a hole and a side of the block and the bottom of the clip fits in the hole between the front surface and rear surface of the block.

3. The combination as described in claim 2, wherein the kit additionally contains two two-piece holders, each piece having a "J"-shape comprising a hook and a face, the hook being so sized as to clasp the outer aspect of the door jamb and the face being so sized as to overlap the face of the other piece, each face having an opening for tightening the holder onto the door jamb by use of a nut and bolt.

4. The combination as described in claim 3, wherein the kit additionally comprises four ties for each block for fitting through the holes to secure the block to the door jamb.

5. The combination as described in claim 4, wherein the kit additionally contains:

(i) two braces, each brace having a top end, a bottom end, and a tubular shaft, each brace having a hole at the top end for attaching the brace to the holder and a hole at the bottom end for attaching the brace to a support and (ii) a support for each brace.

6. The combination as described in claim 5, wherein each support is a flat plate fitted with a hole for attaching to the brace.

7. The combination as described in claim 5, wherein each support is a stake.

8. The combination as described in claim 5, wherein each tubular shaft is telescopic for purposes of adjustment of length and has a tightening mechanism to allow for maintaining the set length.

* * * * *